US012285121B1

(12) United States Patent
Medellin

(10) Patent No.: US 12,285,121 B1
(45) Date of Patent: Apr. 29, 2025

(54) MIRROR AND MOUNTING APPARATUS FOR SINKS FOR SPLASH-FREE WATER FLOSSER USAGE

(71) Applicant: Robert Medellin, Humble, TX (US)

(72) Inventor: Robert Medellin, Humble, TX (US)

( * ) Notice: Subject to any disclaimer, the term of this patent is extended or adjusted under 35 U.S.C. 154(b) by 0 days.

(21) Appl. No.: 18/936,994

(22) Filed: Nov. 4, 2024

Related U.S. Application Data

(63) Continuation of application No. 18/928,015, filed on Oct. 26, 2024.

(51) Int. Cl.
*A47G 1/00* (2006.01)
*A47G 1/16* (2006.01)

(52) U.S. Cl.
CPC .... *A47G 1/1653* (2013.01); *A47G 2001/1673* (2013.01)

(58) Field of Classification Search
None
See application file for complete search history.

(56) References Cited

U.S. PATENT DOCUMENTS 5,444,576 A * 8/1995 Shimada ..... G02B 7/1815 362/345
5,742,956 A * 4/1998 Tarver ..... A47K 4/00 4/663
2003/0140571 A1* 7/2003 Muha ..... A47K 4/00 52/36.2
2020/0347585 A1* 11/2020 Kim ..... H04L 12/2803
2022/0299638 A1* 9/2022 Beckman ..... G01V 8/14

* cited by examiner

*Primary Examiner* — Steven M Marsh
(74) *Attorney, Agent, or Firm* — Donald Debelak

(57) ABSTRACT

A mirror and mounting apparatus that places a water repellent mirror inside the sink covering the sink drain so that a user can see to use a water flosser on his/her mouth during the flossing process while containing the water that spreads out from the mouth during the water flossing process. The device includes a tube plus base that has a slanted top for placing a water repellent mirror which is encased in a water resistant case that contains LED lights. The mirror also has a fog and water resistant coating.

5 Claims, 3 Drawing Sheets

MIRROR AND MOUNTING APPARATUS FOR SINKS FOR SPLASH-FREE WATER FLOSSER USAGE

FIELD OF THE INVENTION

Figure 1:
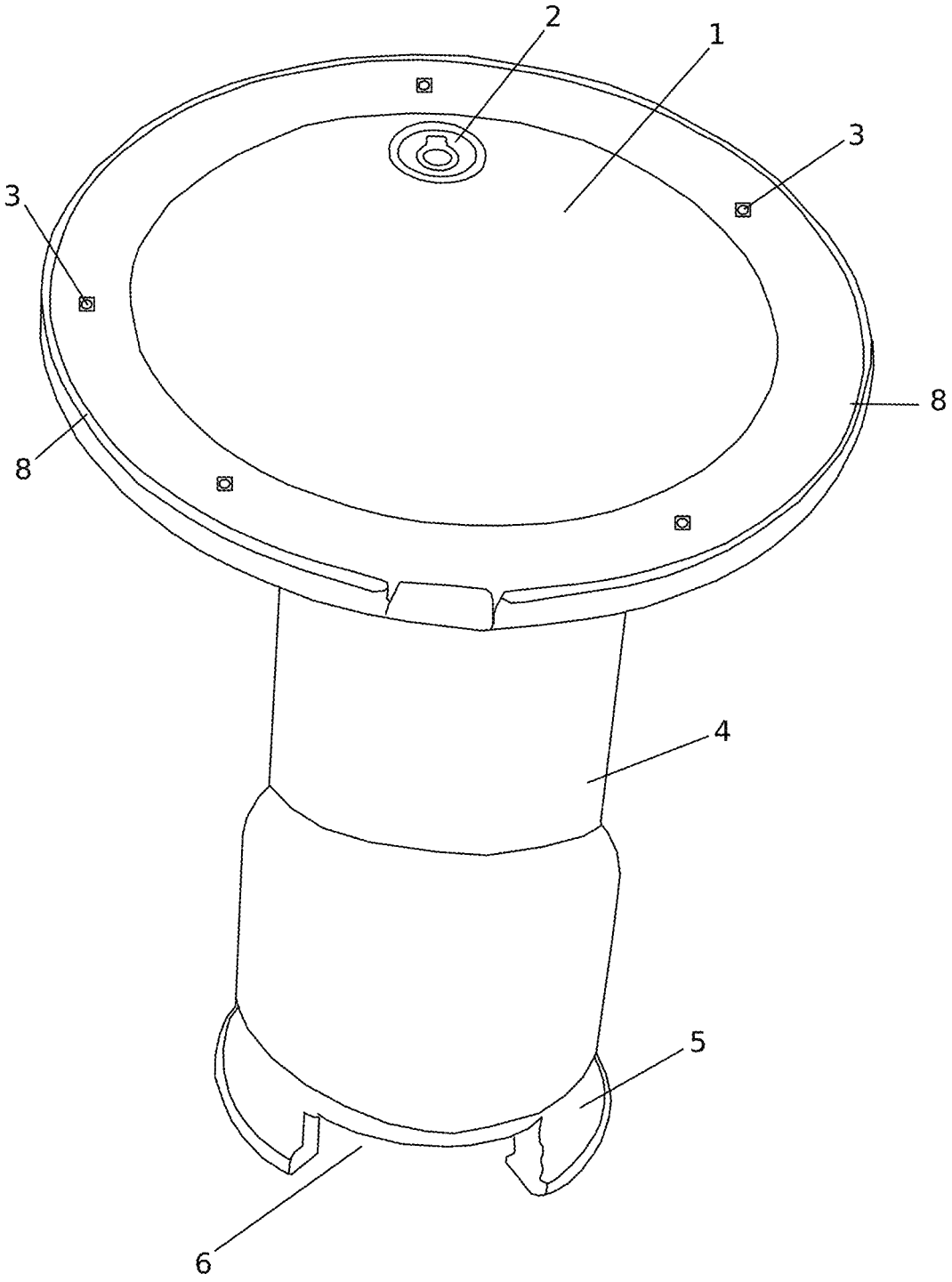

The invention relates generally to sink-contained mirror with a casing with LED lights for splash-free water flosser usage.

BACKGROUND

Water flossing is a dental care technique that uses a handheld device to spray water between and around teeth to remove food and plaque, and to use on the gum/teeth line to minimize the formation of pockets which can lead to periodontal disease. Water flossers can be a good option for people who have trouble flossing with traditional dental floss, such as those with braces, dental work, or conditions that affect the hands. One of the key points, related to the device of this application, is that for water flossers to be most effective, users must watch how the water spray is directed to areas between the teeth and also the gum line.

Currently, there are a number of solutions for dealing with water spray outside the mouth while using water flossers. Some of these solutions attempt to provide basic splash guards or mirrors that can be handheld during use, but these solutions fail to meet the needs of the industry because they require he user to use their free hand, and the solutions are often not stable and easily tip over and come undone. They often require manual holding or positioning with the user's free hand, which can be inconvenient and limit the user's ability to effectively use the water flosser.

Other solutions attempt to incorporate mirrors within the sink area but without built-in lighting features. While these solutions address visibility to some extent, they are insufficient in low-light conditions or areas with inadequate ambient lighting, resulting in compromised visibility during water flosser usage. Still, other solutions seek to provide adjustable mirrors or LED lighting separately, but these solutions fail to meet industry needs because they lack the integration and compactness of a comprehensive device. These are a problem because the user has only one hand free as the other hand is using the using the water flosser. These separate components can be cumbersome to assemble, operate, and maintain, leading to a less user-friendly experience. Overall, existing solutions lack the combined benefits of an integrated mirror aid with built-in LED lighting, adjustable features, and a stable sink attachment mechanism.

The deficiencies in current solutions hinder the user's ability to achieve optimal visibility, convenience, and cleanliness during water flosser usage. Water flosser users would find it desirable to have a bottom of the sink mounted accessory that simplifies the process of using a water flosser while minimizing the typical water splash. Furthermore, users would appreciate having a means of enhancing visibility, for their efforts to observe the proper usage of the water flosser, allowing for more accurate and effective cleaning. The disclosed device advantageously fills these needs and addresses the aforementioned deficiencies by providing a sink-integrated mirror aid with built-in LED lighting for splash-free water flosser use.

SUMMARY OF THE INVENTION

A water repellent mirror and mounting apparatus that places the mirror inside the sink so that a user can see to use a water flosser on his/her mouth during the flossing process, which is made up of the following components a base with a drainage hole, a piece of tubing that connects to the base, the tubing having a slanted top a mirror with a built-in LED lighting and built-in LED lights. These components are connected as follows: The base, containing drainage holes, supports the tubing which in turn holds the mirror at an angle. The built-in LED lights are incorporated within the hosing holding the mirror structure to illuminate the area for better visibility. The associated method is made up of the following steps, first the device is positioned within the sink with the base over the sink drain, with the tubing secured to the base and the mirror positioned on the slanted top. Then, the water flosser is used as usual, while the user watches the process in the mirror under the illumination of the LED lights, and any excess water from the water flosser operation drains through the holes in the base into the sink.

The disclosed device is unique when compared with other known devices and solutions because it provides: (1) A sink located mirror aid with built-in LED lighting, allowing for enhanced visibility during water flosser usage regardless of ambient lighting conditions. The integrated LED lights ensure adequate illumination for a clear view of the user's mouth and teeth. A hands-free solution that combines the mirror, LED lighting, and secure sink attachment in a single device. The integrated design eliminates the need for separate handheld mirrors or additional accessories, offering convenience, stability, and ease of use. These unique features set the disclosed device apart from other available solutions by providing an all-in-one solution that addresses the limitations and deficiencies of existing options. It offers improved visibility, customization, and simplicity in a single device, enhancing the overall user experience during water flosser usage.

This integrated design eliminates the need for separate mirrors and lighting fixtures, streamlining the device and enhancing its functionality. A base with drainage holes, which allows excess water from the water flosser operation to drain into the sink. This structural feature helps to minimize water splash and maintain a clean environment during usage.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Mirror and Mounting Apparatus for Sinks may, however, be embodied in many different forms and should not be construed as being limited to the embodiments set forth herein; rather, these embodiments are provided by way of illustration only and so that this disclosure will be thorough, complete and fully convey understanding to those skilled in the art.

DESCRIPTIONS OF THE NUMBERS IN THE DRAWINGS

1. Water repellent mirror with fog resistant coating

2. Light switch.

3. LED lights in casing.

4. Support tubing made of water resistant material.

5. Base.

6. Drain opening.
7. Slanted top on support tubing.
8. Water resistant casing for the mirror

BRIEF DESCRIPTIONS OF THE DRAWINGS

FIG. 1 A water repellent mirror and mounting apparatus that places the mirror inside the sink on a drain so that a user can see to use a water flosser on his/her mouth during the flossing process.

Figure 2:
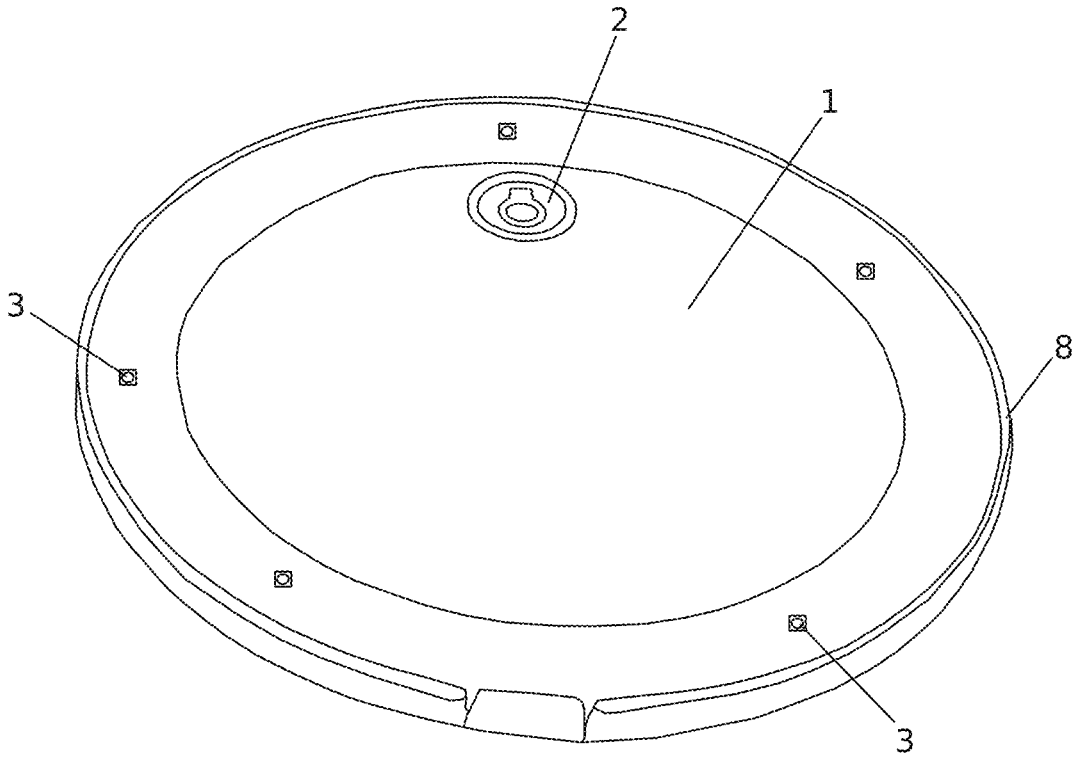

FIG. 2 Water repellent mirror and mirror casing with LED lighting and a light switch.

Figure 3:
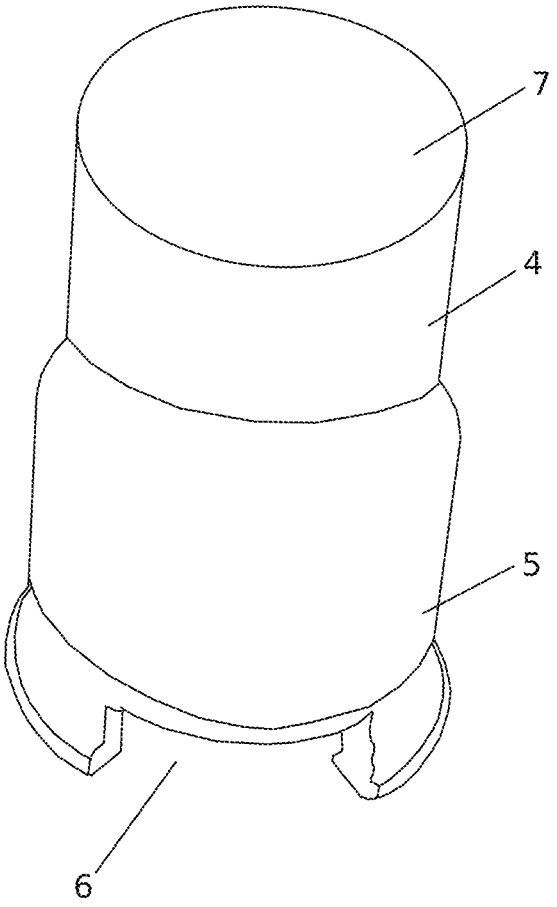

FIG. 3 Support tubing and base showing the slanted top and drain hole on the bottom.

DETAILED DESCRIPTION

FIG. 1 shows the water repellent mirror 1, the mirror's casing 8 and the LED lighting inside the casing 3 with a light switch 2, and the mounting apparatus, consisting of a base 5, tubing 4, and a slanted top 7. The mirror 1 and its casing is set upon the slanted top 7, and the base 5 is placed over the sink drain.

FIG. 2 shows the water repellent mirror 1, and light casing 8 with LED lighting 3 and the light switch 2 as looks before being placed on the slanted top 7 of the tubing 4.

FIG. 3 shows the tube 4, with the slanted top 7. The base 5 and the drain 6.

The present invention is directed to a water repellent mirror and mounting apparatus that places the mirror inside the sink covering the sink drain so that a user can see to use a water flosser on his/her mouth during the flossing process while containing the water that spreads out from the mouth during the water flossing process comprising following components: a base with drainage holes; a tubing mechanism made of water resistant material, a mirror with casing, the casing with built-in LED lights and an anti-fog coating.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by this disclosure. It is indeed intended that the scope of this disclosure should be determined by a proper legal interpretation and construction of the disclosure, including equivalents, as understood by those of skill in the art relying upon the complete disclosure present at the time of filing.

I claim:

1. A mirror and mounting apparatus for placing over a sink drain comprising;
a mirror;
a mirror casing;
LED lights within the casing;
a mirror support tubing;
a base to hold the support tubing;
the base with a front opening;
wherein the base covers a sink drain, the mirror support tubing fits into the base and the mirror and casing rest on the top of the mirror support tubing.

2. The mirror of claim 1 being water repellent.

3. The mirror casing of claim 1 made of water resistant material.

4. The mirror of claim 1 with an anti-fog coating.

5. The support tubing of claim 1 made of water resistant material.

* * * * *